US005788051A

United States Patent [19]

Knoepfel et al.

[11] Patent Number: 5,788,051

[45] Date of Patent: Aug. 4, 1998

[54] DEVICE FOR TRANSFERRING SPRINGS TO AN ASSEMBLY MACHINE

[75] Inventors: Hans Knoepfel, Roggwil; Siegfried Grueninger, Gallen, both of Switzerland

[73] Assignee: Spuehl AG, St. Gallen, Germany

[21] Appl. No.: 747,578

[22] Filed: Nov. 15, 1996

[30] Foreign Application Priority Data

Nov. 17, 1995 [DE] Germany ..... 195 42 844.7

[51] Int. Cl.[6] ..... B65G 47/34

[52] U.S. Cl. ..... 198/429; 140/3 CA; 140/92.8

[58] Field of Search ..... 140/3 CA, 92.8; 198/429; 414/225

[56] References Cited

U.S. PATENT DOCUMENTS

| | | | |
|---|---|---|---|
| 1,948,754 | 2/1934 | Gail | 140/3 CA |
| 2,878,919 | 3/1959 | Jones | 198/429 X |
| 3,774,652 | 11/1973 | Sturm | 140/3 CA |
| 4,014,371 | 3/1977 | Walker et al. | 140/3 CA |
| 4,413,659 | 11/1983 | Zängerle | 198/430 X |
| 4,686,753 | 8/1987 | Zapletal et al. | 140/92.8 X |
| 4,724,590 | 2/1988 | Langas et al. | 140/3 CA X |

FOREIGN PATENT DOCUMENTS

3416110 C2 10/1986 Germany .

*Primary Examiner*—Janice L. Krizek

*Attorney, Agent, or Firm*—Lackenbach Siegel Marzullo Aronson & Greenspan, P.C.

[57] ABSTRACT

Device for transferring springs to an assembly machine, wherein the sprints to be transferred are retained in a guide device wherein for the transfer of the springs sliders are provided engaging at the end winds of the springs.

8 Claims, 2 Drawing Sheets

DEVICE FOR TRANSFERRING SPRINGS TO AN ASSEMBLY MACHINE

Figure 1:
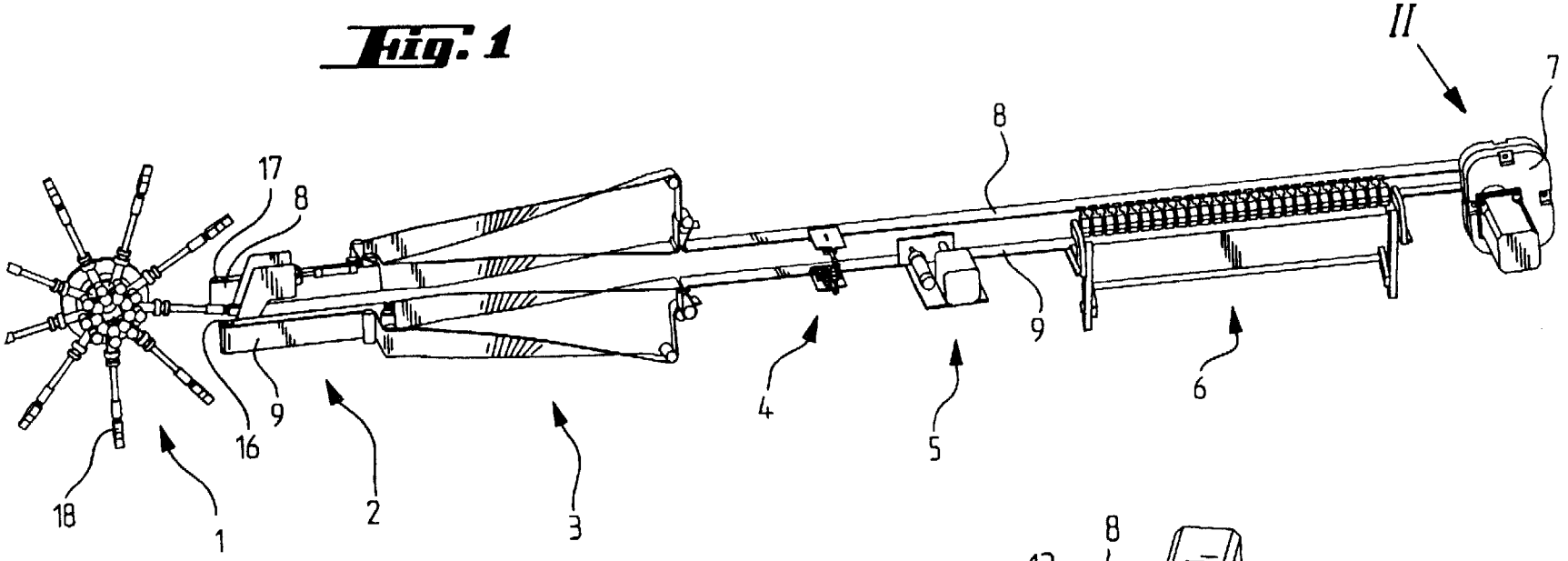

The invention relates to a transfer device for transferring springs to an assembly machine.

Such machines serve the purpose of supplying to a device finished springs appropriate for processing and positioning correctly, in which device the springs are assembled to form inner spring cores and upholstered or seating cushions.

Characteristic of such a spring emplacement station is that from a spring production machine, not further described within the scope of the present invention, a spring is grasped in one gripper hand of a multi-arm transport star, and this spring is subsequently supplied via a spring emplacement station and various other succeeding stations to the assembly machine.

In a patent by the same applicant according to DE 34 16 110 C2 a spring production machine is described in which a transport star is disclosed.

Each of the springs produced in this station is placed into the particular gripper had of the transport star and there grasped while being clamped and supplied for further processing.

The spring emplacement station performs functions in such a way that pivot jaws in the extension range of the particular gripper hand of the transport star are available, which receive between them the sprig. The spring from the gripper hand of the transport star is placed into these pivot jaws. However, with such a pivot motion of the receiving jaws in the region of the spring emplacement station the disadvantage is that the springs placed into the spring emplacement station could not be positioned precisely enough. This entailed the disadvantage that the spring had to be aligned precisely via a relatively large number of succeeding alignment stations which were tied to increased machine expenditures.

It is herein known that the springs held in a belt gap of the belt is grasped in the center of the spring and pulled from this belt gap. However, this has the disadvantage that with very high and very soft springs the end winds (which must actually be positioned precisely in the succeeding mounting pincers) are displaced as a consequence of the friction on the limb of the belt and thus can no longer be introduced into the mounting pincers in the correct position (U.S. Pat. No. 3,774,652)).

A further friction resistance obtains at such a displacement arrangement on the guide sheets disposed parallel to the limbs of the belt, wherein the danger also existed that the end winds, due to friction on the guide sheets, were displaced resiliently and the secure placement into the succeeding mounting pincers could no longer be ensured.

The remedy previously used was that several center winds of the spring were grasped with halfshell-like holding tools in order to ensure the greatest possible encompassing surface of the spring. But his led to the disadvantage that the end winds were still not guided securely and therefore the secure introduction of a spring displaced in such way into mounting pincers, in which the end winds were intended to be grasped, was not ensured.

It is the purpose of the present invention to create a transfer device with which it is possible to supply in as simple a way as possible springs to a succeeding assembly machine, which springs are disposed serially one after the other and at discrete intervals one from the other.

To solve the proposed task, the invention is characterized thereby that the transfer device comprises a series of sliders wherein each slider comprises an upper and a lower slider end wherein the particular free ends of the upper and lower slider end come to rest on the associated end winds of the springs to be displaced. The slider ends are preferably resiliently prestressed one relative to the other.

The purpose of such slider device is to grasp the springs, disposed in a belt gap of two synchronously driven belt loops one behind the other, synchronously and serially, i.e. for example up to 40 springs and to transport these transversely to the direction of the belt transport from the belt in order to guide these springs into the gripper gap of succeeding upper and lower mounting pincers.

As already explained, the slider ends are spring-loaded and prestressed relative to one another in the direction of the longitudinal axis of the spring. A further characteristic is that the slider configuration with these prestressed [slider ends] extends into tie gap between the limbs of the belt of the belt loops associated with one another and is prestressed against the upper and lower belt with spring tension. In this way a secure attack of the slider ends on the upper and lower end winds of the springs to be slid is achieved.

Through the prestress of the slider ends against the upper and lower belt (in each instance the inside of the limb of the belt) is achieved that the end winds of the springs retained between the belt limbs cannot slip past the sliders and the slider thus can grasp these end winds securely.

Herein one embodiment of the invention prefers that the slider ends are provided with slider blocks in order to achieve an even better contact on the end wind. It is herein preferred that every slider block forms an approximately vertical contact face for the contact on the associated end wind of the spring in order to attain a secure and closely fitting contact on the particular end wind.

Thereby is achieved that the slider blocks used here are pushed under spring force of the sliders implemented of spring steel, against the inside of the particular opposing belt limbs and, consequently, the end winds of the springs to be displaced can be brought securely into contact on the straight displacement faces of these slider blocks without these end winds being able to slip past the spring-loaded slider blocks.

The invention provides that from the outset the slider configuration engages on the end winds of the springs and the slider configuration under spring prestress is allowed to grasp the end wind so that the end winds without danger of deformation or through friction can be introduced in the correct position and securely into the gripping gap of upper and lower mounting pincers.

A further important advantage of the present invention is that the slider configuration is disposed so as to be directly flush with the mounting device so that a height of set can be omitted. In known configurations of prior art the slider configuration must first bring the springs from the region onto a corresponding transport belt, lift the springs, for example vertically, in order to supply, on a second plane disposed vertically above it, the springs to an assembly machine.

This requires an increased machine expenditure which is avoided according to the present invention.

In a preferred embodiment of the invention it is provided that the sliders a driven synchronously via a corresponding swivel device. Herein a motor or another rotary drive is used whose rotary motion is converted via a corresponding transmission gear into a linear displacement motion of the slider.

It is understood that in another embodiment of the present invention this rotary drive can be omitted and the sliders can be displaced directly via an associated linear displacement drive.

It can further be provided that the interval between the individual sliders (wherein with each spring a slider is associated) can be individually adjusted. For this purpose there is provided that the sliders are disposed on a corresponding mounting and are disposed on this mounting so as to be displaceable and arrestable in the direction of transport of the belt and in the opposite direction. In this way the discrete interval between the springs can be reproduced through the corresponding displaceable and arrestable mounting of the associated sliders so that with each spring a corresponding slider is associated in the corresponding position. Consequently, the springs are introduced with the slider configuration according to the invention with the springs in the correct position into the assembly machine. directly flush, for example, in the horizontal plane.

It is understood that the working direction of the present slider device is not absolute. It can also be provided that the sliders operate in the vertical direction and the assembly machine also accepts these springs in the vertical direction.

The inventive subject matter of the present invention is not only evident from the subject matter of the individual patent claims but also from the combination of individual patent claims.

Figure 2:
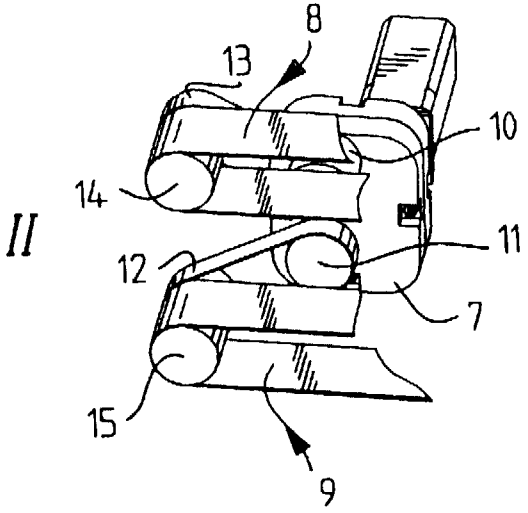
Figure 3:
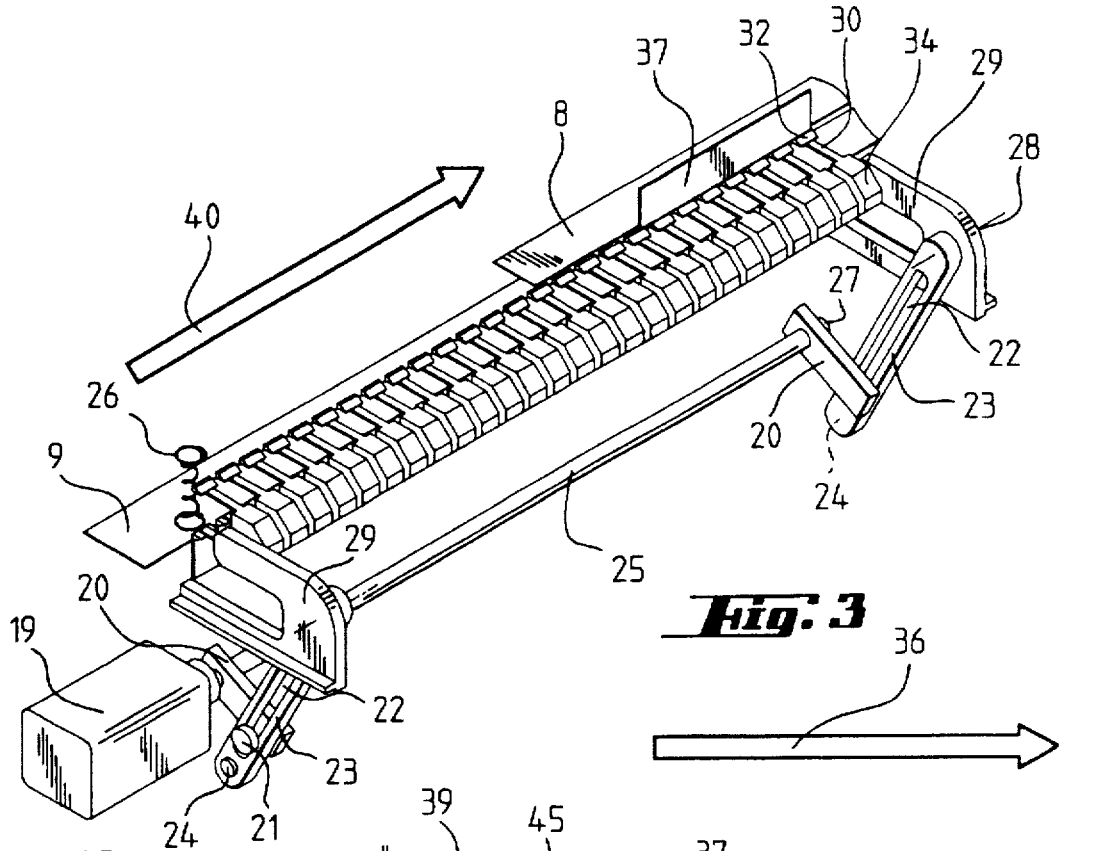
Figure 4:
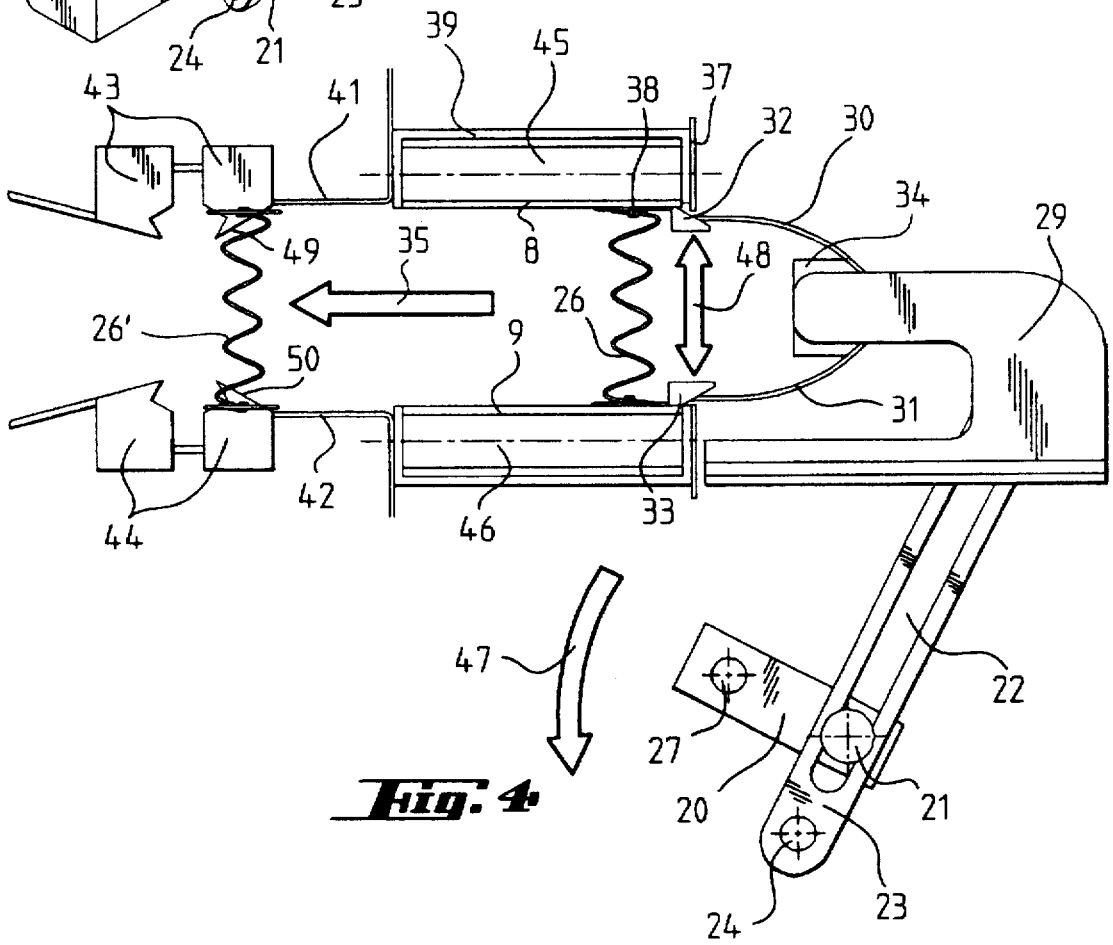

All specifications and characteristics, including the abstract, in particular the spatial development depicted in the drawings are claimed as being essential to the invention to the extent they are novel individually or in combination relative to prior In the following the invention will be explained in further detail in conjunction with drawings showing only one manner of implementation Herein in the drawings and their description further characteristics and advantages of the invention essential to the invention are evident in which:

FIG. 1 a schematically drawn overview over a complete transport station starting from a transport star up to a transfer machine, FIG. 2 schematically the synchronous belt drive for the two belt loops, FIG. 3 the transfer device schematically in perspective view, and FIG. 4 a front view of the transfer device according to FIG. 3.

FIG. 1 shows that a transport star is formed by a multi-arm gripper mechanism which comprises a number of gripper hands wherein into each gripper hand 18 a corresponding spring 26 is placed and is retained there while being clamped.

The gripper hand 18 introduces the spring 26 into a spring emplacement station 2.

After the spring 26 has been placed into the spring emplacement station 2 and oriented in the correct position, this spring is moved to a turning station 3, wherein the spring is rotated from a horizontal position into a vertical position.

At the exit of the turning station a first alignment station 4 is disposed which, as a check alignment station, only checks whether or not the knot 38 of the spring 26 was positioned correctly in the spring emplacement station 2.

A further alignment station 5 ensures that of a series of springs disposed one behind the other in the region of the belt loops 8, 9 in each instance the last spring of the preceding series is removed, turned and again inserted into the belt gap of the belt loops 8, 9 as the first spring of the succeeding series.

Succeeding the alignment station 5 is disposed a transfer device 6 in which the springs successively and in the correct position are aligned so as to be positioned precisely and serially and are subsequently transferred wit a transverse slider system into an assembly machine disposed transversely to the belt loops 8, 9.

The synchronous driving of the belt loops 8, 9 takes place through a belt drive 7 which is shown in greater detail in FIG. 2.

A single central drive is used which drives via a gearing two synchronously driven drive shafts 10, 11. Via each drive shaft 10, 11 runs in each instance a toothed belt 12, 13 which drives one deflection roller 14, 15 free of slip.

The belt loop 8 and 9 is guided via the particular deflection roller 14, 15.

Each belt loop comprises an upper and lower limb and between the libs facing each other of these belt loops 8, 9 the spring 26 to be emplaced is emplaced.

The belt drive 7 is freely programmable wherein the driving motor can also be implemented as a stepping motor, and it is thus possible at the same emplacement speed into the belt of the transport star I to adjust through corresponding variation of the belt drive the precise and different intervals between the springs.

The two belt loops 8, 9 run via the front deflection rollers 16, 17 and are there deflected.

FIG. 3 shows in perspective view the side view of a transfer arrangement 6.

Herein the springs 26 are held in the belt gap between the bed loops 8, 9 driven synchronously with respect to each other and are transported in the direction of transport 40.

The transfer device 6 comprises essentially a motor 19 or another rotary drive whose axis of rotation is connected with a crank so as to be torsion-tight.

The drive shaft of the motor 19 is further connected with a connecting rod 25 so as to be torsion-tight, which connecting rod is rotatably retained at the opposing end in the region of a pivot bearing 27 stationarily on the machine.

Since on the opposing side of the slider configuration an identical configuration is depicted, it is sufficient to describe only the left drive of his displacement device.

The free pivotable end of the crank 20 is provided with a crank pin 21 which is freely displaceable in a longitudinal hole 22 of a lever 23. Tis lever 23 is pivoted in a stationary pivot bearing 24.

The free upper end of lever 23 is connected with a slide flange 29 so as to be rotatable with a connecting pin 28. At the front free end of the slide flange 29 in the region of a mounting 34 the sliders 30 and 31 are attached. It has already been mentioned above that this mounting 34 permits displacing and arresting the sliders 30 and 31 on the slide flange 29 in the direction of transport 40 and in the opposite direction.

Each slider comprises spring sheet steel or another resilient, essentially U-form part at whose free ends a slider block 32, 33 is disposed.

This slider block 32, 33 is preferably implemented of synthetic material and comprises a front slider edge, oriented approximately vertically, with which his slider block comes to rest on the outer circumference of the particular upper and lower end wind of the particular spring 26.

Of importance is that the ends of the sliders 30 and 31 are prestressed relative to each other in the directions 48 of the arrows so that the slider blocks 32, 33 come to rest under the spring load on the inner sides of the particular limb of the belt. loops 8, 9.

In the same way the springs 26 are held under compression sequentially between these limbs of the belt loops 8, 9, wherein in this region (sliding region of the transfer device) with each slider are associated in each instance upper and lower guide rollers 45, 46 in order to counteract the undesirable excursion upwardly or downwardly of the belt limb in his region.

The belt loops 8, 9 are additionally guided by a guide plate 37 and by a guide sheet 39.

It is understood that the distance from each other of the belt loops 8, 9 as well as of the guide sheets 41, 42 disposed next to the belt loops 8, 9 can be adapted to different heights or lengths of the springs to be processed. This adaptation is known to the person skilled in the art and is therefore not shown in further detail. The same applies to the clearance of the succeeding mounting pincers 43, 44.

In the engagement position shown in FIG. 4 accordingly the slider blocks 32, 33 come to rest under spring load on the end winds of the particular springs 26 wherein the knots 38 of the springs are aligned wit precise definition.

The entire slider device is subsequently rotated in the direction of arrow 47 by switching on the drive 19 so that the slide flange 29 executes a linear displacement motion in the direction of arrow 35 and herein shifts the entire spring series (spring packet) in the direction of arrow 35 out of the belt gap via succeeding, correspondingly aligned, guide sheets 41, 42 and herein slides the end winds directly into the region of upper and lower mounting pincers 43, 44 of the succeeding assembly machine.

It is herein preferred if in the entry region of the mounting pincers 43, 44 associated entry obliquities 49, 50 are present which are directed obliquely toward each other. This ensures that during the displacement into these mounting pincers 43, 44 the springs are once again more strongly compressed in the direction of their longitudinal axis in order to subsequently allow the springs to snap apart after having overcome the entry obliquity 49, 50 and to bring them expandingly into the corresponding receiving opening of the mounting pincers 43, 44.

The succeeding assembly machine accepts the entire spring packet and assembles His spring packet to form a mattress, a mattress core or an upholstery cushion core.

After the springs have been slid into the mounting pincers 43, 44 the entire slider configuration executes a retrograde motion in the direction of arrow 36 wherein the rotary drive always drives the entire configuration uniformly in the direction of arrow 47. Thus, as the drive a slider crank is suggested.

The general part already described that, instead of the slider crank specified here, a linear displacement drive of the slide flange 29 in the directions of arrow 35, 36 can also be provided.

The use of a slider crank has the advantage that at the point of the sliding-in of the particular spring 26 via the entry obliquities 49, 50 a very low speed of the spring but a high force is given so that the springs are slid very securely into the receiving openings of the mounting pincers 43, 44.

It s herein essential that in the displacement position shown in FIG. 4 the slide configuration with the slide flange 29 initially approaches the springs at low displacement speed and displaces at increasing speed these springs along the parallel facing of the belt loops until the springs move into the region of the guide sheets 41, 42 where the speed decreases but the displacement force becomes increased. Consequently, this force reaches its maximum value in the region of introduction of the springs 26 into the mounting pincers. Therefore the springs 26 are securely introduced into the mounting pincers 43, 44.

Overall, with the present invention a simple and precise realization is obtained for supplying to a succeeding assembly machine springs disposed at discrete intervals with respect to each other.

Legends of Symbols in the Drawing

1 Transport star
2 Spring emplacement station
3 Turning station
4 Aligning station
5 Aligning station
6 Transfer device
7 Belt drive
8 Rear (upper) belt loop
9 Front (lower) belt loop
10 Drive shaft (top)
11 Drive shaft (bottom)
12 Tooted belt
13 Toothed belt
14 Deflection roller (rear)
15 Deflection roller (rear)
16 Deflection roller (front)
17 Deflection roller (front)
18 Gripper hand
19 Motor
20 Crank
21 Crank pin
22 Longitudinal hole
23 Lever
24 Pivot bearing
25 Connecting rod
26, 26' Spring
27 Pivot bearing
28 Connecting pin
29 Slide flange
30 Slider
31 Slider block top
33 Slider block bottom
34 Mounting
35 Direction of arrow
36 Direction of arrow
37 Guidance plate
38 Knot
39 Guidance sheet
40 Direction of transport
41 Guide sheet top
42 Guide sheet bottom
43 Mounting pincers top
44 Mounting pincers bottom
45 Guidance roller top
46 Guidance roller bottom
47 Swivel device
48 Direction of arrow
49 Entry obliquity
50 Entry obliquity

We claim:

1. Device for transferring springs to an assembly machine wherein the springs to be transferred each have opposing end winds and are retained and transported individually one after the other in the guide device along a transport direction, the transfer device comprising a series of sliders each having an upper and a lower slider end for continuously engaging respective end winds of the springs to move the springs transversely in regard to the transport direction of the guide device into said assembly machine.

2. Device for transferring springs as stated in claim 1, characterized in that the sliders (30) are produced of resilient material.

3. Device for transferring springs as stated in claim 1 or 2, characterized in that the ends of the sliders (30) are prestressed relative to each other.

4. Device for transferring springs as stated in claim 1, characterized in tat the ends of the sliders (30) are provided with slider blocks (32, 33).

5. Device for transferring springs as stated in claim 1, characterized in that the lateral distance between the sliders (30) can be adjusted.

6. Device for transferring springs as stated in claim 1, characterized in that the guide device is implemented in the form of synchronously driven belt loops (8, 9).

7. Device for transferring springs as stated in claim 1, characterized in tat a support of the guide device (8, 9) is provided in the region of the sliders (30).

8. Device for transferring springs as stated in claim 1, characterized in that said guide device comprises two belt loops spaced from each other a distance that can be adjusted.

* * * * *